US010669705B2

(12) United States Patent
Willert

(10) Patent No.: US 10,669,705 B2
(45) Date of Patent: Jun. 2, 2020

(54) TOILET BOWL TREATMENT APPARATUS AND METHOD OF MAKING SAME

(71) Applicant: Willert Home Products, Inc., St. Louis, MO (US)

(72) Inventor: Bryan Bruce Willert, Saint Louis, MO (US)

(73) Assignee: Willert Home Products, Inc., St. Louis, MO (US)

( * ) Notice: Subject to any disclaimer, the term of this patent is extended or adjusted under 35 U.S.C. 154(b) by 36 days.

(21) Appl. No.: 15/202,416

(22) Filed: Jul. 5, 2016

(65) Prior Publication Data

US 2018/0010323 A1 Jan. 11, 2018

(51) Int. Cl.
*E03D 9/03* (2006.01)
*E03D 9/02* (2006.01)

(52) U.S. Cl.
CPC ..... *E03D 9/032* (2013.01); *E03D 2009/024* (2013.01); *E03D 2009/026* (2013.01)

(58) Field of Classification Search
CPC ... E03D 9/032; E03D 2009/024; E03D 9/022; E03D 2009/026; E03D 2009/028; E03D 9/02; E03D 9/03
USPC ..... D23/208, 368; 294/31.2, 33
See application file for complete search history.

(56) References Cited

U.S. PATENT DOCUMENTS 3,275,366 A * 9/1966 Hidding ..... A45F 5/10 215/396
3,688,936 A * 9/1972 Killigrew, Jr. ..... A47G 19/12 16/425
3,807,679 A * 4/1974 Burke ..... A47G 23/0241 215/399
4,254,513 A * 3/1981 Cretin ..... E03D 9/032 4/231
D292,605 S * 11/1987 Shaer ..... D23/208
5,336,427 A 8/1994 Bunczk et al.
D355,474 S 2/1995 Kearnes et al.
5,395,546 A 3/1995 Hung et al.
D361,109 S 8/1995 Davis, Jr.
5,449,473 A 9/1995 Bunczk et al.
5,457,822 A 10/1995 Klammsteiner
D376,420 S 12/1996 Rymer
5,611,465 A 3/1997 Lee et al.
5,673,439 A 10/1997 Kuo
D387,848 S 12/1997 Thompson et al.
D392,021 S 3/1998 Bodker et al.
(Continued)

FOREIGN PATENT DOCUMENTS

FR 2253129 A1 * 6/1975 ..... E03D 9/032
GB 2339209 A1 1/2000
WO 2016040341 A1 3/2016

OTHER PUBLICATIONS

Machine translation of FR-2253129-A1, dated Jun. 1975. (Year: 1975).*

*Primary Examiner* — Joseph L. Perrin
*Assistant Examiner* — Kevin G Lee
(74) *Attorney, Agent, or Firm* — Armstrong Teasdale LLP

(57) ABSTRACT

A toilet bowl treatment apparatus is provided. The apparatus includes a hanger having a detent, and a blister-type cartridge having a tray, a treatment material disposed in the tray, and a cover removably coupled to the tray over the treatment material. The cartridge also has a detent that releasably engages the detent of the hanger for detachably coupling the cartridge to the hanger.

17 Claims, 5 Drawing Sheets

(56) References Cited

U.S. PATENT DOCUMENTS

D392,022 S 3/1998 Bodker et al.
D395,071 S 6/1998 Bodker et al.
5,829,066 A 11/1998 Aibe
5,839,128 A 11/1998 Wang
5,862,532 A 1/1999 Cain
5,903,930 A 5/1999 Huang
5,945,390 A 8/1999 Veltman et al.
5,958,334 A 9/1999 Haddon
6,003,161 A 12/1999 Tomaini
D419,347 S 1/2000 Leonard
6,041,449 A 3/2000 Brown et al.
D423,639 S 4/2000 Leonard
6,055,679 A 5/2000 Goelz et al.
6,096,698 A 8/2000 Milling
6,101,639 A 8/2000 Hsu
6,145,137 A 11/2000 Tomaini
D436,160 S 1/2001 Leonard et al.
6,184,192 B1 2/2001 Klinkhammer
6,189,696 B1 2/2001 Tuerk et al.
6,192,524 B1 2/2001 Black
6,211,128 B1 4/2001 Black
6,230,334 B1 5/2001 Camp et al.
6,240,572 B1 6/2001 Van Der Gaag et al.
6,311,340 B1 11/2001 Thompson
6,376,442 B1 4/2002 Perthuisot et al.
6,389,610 B1 5/2002 Hautmann et al.
6,434,758 B2 8/2002 Camp et al.
D464,107 S 10/2002 Holmes et al.
D466,583 S 12/2002 Heijdenrijk
6,505,356 B1 1/2003 Leonard et al.
6,510,561 B1 1/2003 Hammond et al.
6,519,783 B2 2/2003 Falchieri
D475,118 S 5/2003 Legeay
D476,056 S 6/2003 Woolley et al.
6,591,431 B2 7/2003 Hautmann et al.
6,625,821 B2 9/2003 Lhoste
D480,462 S 10/2003 Conway et al.
D481,099 S 10/2003 Legeay
D481,100 S 10/2003 Legeay
D481,440 S 10/2003 Bernarducci
6,647,558 B2 11/2003 Falchieri
6,651,261 B1 11/2003 Leonard et al.
D484,566 S 12/2003 Legeay
6,654,970 B1 12/2003 Van
6,662,380 B1 12/2003 Leonard et al.
6,675,396 B2 1/2004 Varanasi et al.
6,691,329 B2 2/2004 Slade
6,738,989 B2 5/2004 Harbutt et al.
6,748,610 B2 6/2004 Zach et al.
D496,711 S 9/2004 Conway et al.
D498,566 S 11/2004 Schick et al.
6,820,287 B2 11/2004 Harbutt et al.
D500,548 S 1/2005 Conway et al.
D500,550 S 1/2005 Bariou et al.
D501,532 S 2/2005 Weller et al.
6,848,852 B2 2/2005 Engert
6,854,136 B2 2/2005 Leonard et al.
D502,530 S 3/2005 Neiman et al.
6,895,605 B2 5/2005 Pagani
6,898,806 B2 5/2005 Keramidas
D506,803 S 6/2005 Love et al.
D506,805 S 6/2005 Nguyen et al.
D507,627 S 7/2005 Nguyen et al.
D507,628 S 7/2005 McLellan et al.
D508,106 S 8/2005 Nguyen et al.
D508,549 S 8/2005 Keramidas
6,928,667 B2 8/2005 Kuhn et al.
6,928,668 B2 8/2005 Kuhn
6,934,973 B2 8/2005 Lehmann et al.
6,948,193 B2 9/2005 Hsu et al.
D511,806 S 11/2005 Nguyen et al.
D512,480 S 12/2005 Nguyen et al.
D512,771 S 12/2005 Conway et al.
6,976,277 B2 12/2005 Keramidas
D514,661 S 2/2006 Weller et al.
6,993,796 B1 2/2006 Hammond et al.
7,013,498 B1 3/2006 Smith et al.
D520,622 S 5/2006 Yamamoto et al.
7,039,960 B2 5/2006 Pagani
D523,923 S 6/2006 Nguyen et al.
7,069,602 B1 7/2006 Conway et al.
7,114,199 B2 10/2006 Conway et al.
D534,641 S 1/2007 Chen
D536,059 S 1/2007 King et al.
D537,914 S 3/2007 King et al.
D540,907 S 4/2007 Liu
D541,902 S 5/2007 Cheung et al.
D543,258 S 5/2007 Liu
D544,953 S 6/2007 Kee
7,234,175 B2 6/2007 Wilson et al.
D547,418 S 7/2007 King et al.
D548,304 S 8/2007 King et al.
D548,305 S 8/2007 King et al.
D550,344 S 9/2007 Weggelaar
D550,345 S 9/2007 Weggelaar
D552,710 S 10/2007 King
D555,757 S 11/2007 Cheung et al.
D555,758 S 11/2007 King et al.
D556,854 S 12/2007 Cheung et al.
D558,854 S 1/2008 Burt
D558,855 S 1/2008 Arora et al.
D558,856 S 1/2008 King
7,322,052 B2 1/2008 Alexander
D564,063 S 3/2008 Burt et al.
D564,620 S 3/2008 Burt et al.
D565,693 S 4/2008 Keramidas
D568,960 S 5/2008 Cheung et al.
D571,432 S 6/2008 Hardwick
D573,687 S 7/2008 Hill
D574,922 S 8/2008 Cheung et al.
D582,026 S 12/2008 Weggelaar
D583,902 S 12/2008 Cheung et al.
D588,688 S 3/2009 Lablaine
7,511,004 B2 3/2009 Cheung et al.
D590,912 S 4/2009 Woolman et al.
D591,824 S 5/2009 Leonard et al.
D592,947 S 5/2009 Neves et al.
D594,953 S 6/2009 King et al.
D595,388 S 6/2009 Leonard et al.
D595,389 S 6/2009 Leonard et al.
D598,737 S 8/2009 Neves et al.
D600,317 S 9/2009 Enever et al.
7,603,726 B2 10/2009 Sawalski et al.
D604,976 S 12/2009 Waymire
D607,537 S 1/2010 Enever et al.
D607,967 S 1/2010 Enever et al.
7,676,856 B1 3/2010 Graham, II
D613,368 S 4/2010 Padain et al.
D613,369 S 4/2010 Enever et al.
7,709,433 B2 5/2010 Veltman et al.
7,721,358 B2 5/2010 Park et al.
7,788,740 B2 9/2010 De Belder et al.
7,832,025 B2 11/2010 Virica et al.
D632,843 S 2/2011 Wilson et al.
7,895,683 B2 3/2011 Sawalski et al.
7,908,680 B2 3/2011 Akitsu
7,971,284 B2 7/2011 Pessel et al.
D643,101 S 8/2011 Abbondanzio et al.
D645,948 S 9/2011 Iwasawa et al.
8,015,629 B2 9/2011 Nguyen et al.
8,032,953 B2 10/2011 Wilson et al.
8,051,503 B2 11/2011 Nguyen et al.
D650,523 S 12/2011 Wilson et al.
D650,524 S 12/2011 Wilson et al.
8,099,800 B2 1/2012 Sawalski et al.
D655,778 S 3/2012 Mühlhausen
D656,575 S 3/2012 Mühlhausen
D656,576 S 3/2012 Mühlhausen
D657,175 S 4/2012 Alnkhailan
D659,793 S 5/2012 Mühlhausen
8,181,282 B2 5/2012 Butter-Jentsch et al.
D662,174 S 6/2012 Reijnders
8,197,739 B2 6/2012 Lu
8,220,080 B2 7/2012 Sawalski et al.

(56) References Cited

U.S. PATENT DOCUMENTS

D667,944 S 9/2012 Richard et al.
8,266,728 B2 9/2012 Bulala et al.
8,266,729 B2 9/2012 Pagani
8,277,715 B2 10/2012 Arora et al.
8,291,523 B2 10/2012 Virica
8,291,524 B2 10/2012 Leonard et al.
8,307,467 B2 11/2012 Bulala et al.
8,316,471 B2 11/2012 Pessel et al.
8,367,595 B2 2/2013 Cheung et al.
D679,778 S 4/2013 Gerhards
8,424,122 B2 4/2013 Frey
8,453,273 B1 6/2013 Morad
8,510,872 B2 8/2013 Muehlhausen et al.
D689,167 S 9/2013 Gerhards
8,549,675 B2 10/2013 Abbondanzio et al.
8,551,259 B2 10/2013 Wiedemann
D692,995 S 11/2013 Cogswell
8,603,257 B2 12/2013 Burt et al.
8,615,820 B2 12/2013 Arora et al.
8,616,796 B2 12/2013 Lobl
D698,004 S 1/2014 Bruining et al.
D698,414 S 1/2014 Bruining et al.
D698,430 S 1/2014 Dobler et al.
8,664,172 B2 3/2014 Veltman et al.
8,685,304 B2 4/2014 Arora et al.
8,695,124 B2 4/2014 Hsu
8,719,971 B2 5/2014 Burt et al.
8,776,277 B2 7/2014 Leo et al.
8,820,664 B2 9/2014 Sawalski et al.
8,858,879 B2 10/2014 Lu et al.
D720,427 S 12/2014 Wang et al.
D720,428 S 12/2014 Wang et al.
8,925,119 B2 1/2015 Burt
D722,154 S * 2/2015 Muller ..... D23/368
D723,677 S 3/2015 Broxton, Jr.
8,966,674 B2 3/2015 Lu et al.
8,987,182 B2 3/2015 Warkotsch et al.
D726,893 S 4/2015 Müller
9,003,572 B2 4/2015 Knorr et al.
D729,368 S 5/2015 Markwick et al.
D737,947 S 9/2015 Dobler et al.
D738,990 S 9/2015 Gerhards
D748,222 S 1/2016 Gerhards
9,234,338 B2 1/2016 Irwin et al.
D750,199 S 2/2016 Gerhards
D750,200 S 2/2016 Gerhards
D752,198 S 3/2016 Zach et al.
D752,733 S 3/2016 Zach et al.
9,278,152 B2 3/2016 Irwin et al.
D754,814 S 4/2016 Warden et al.
9,334,640 B2 5/2016 Burt et al.
9,366,016 B2 6/2016 Butter-Jentsch et al.
2002/0083514 A1 7/2002 Lhoste
2002/0148036 A1 10/2002 Wilson et al.
2003/0106143 A1* 6/2003 Lhoste ..... E03D 9/032 4/222
2003/0156976 A1 8/2003 Wilson et al.
2003/0207964 A1 11/2003 Gazzaniga et al.
2004/0068782 A1 4/2004 Butter-Jentsch et al.
2004/0088781 A1 5/2004 Suffa
2004/0099562 A1 5/2004 Vazquez
2004/0107484 A1 6/2004 Butter-Jentsch et al.
2004/0172740 A1 9/2004 Yang
2004/0172741 A1 9/2004 Troost
2004/0216391 A1 11/2004 Papadaki et al.
2004/0220067 A1 11/2004 Papadaki et al.
2005/0014668 A1 1/2005 Bariou et al.
2005/0247725 A1 11/2005 Smith
2005/0273918 A1 12/2005 Bernarducci
2006/0053538 A1 3/2006 Troost
2006/0053539 A1 3/2006 Hammond et al.
2006/0070172 A1 4/2006 Pagani
2006/0123528 A1 6/2006 Pagani
2006/0130221 A1 6/2006 Bulala et al.
2006/0137081 A1 6/2006 Ferrara et al.
2006/0213002 A1 9/2006 Pagani
2007/0067897 A1 3/2007 Graham
2007/0204389 A1 9/2007 Graefe et al.
2007/0214555 A1 9/2007 Ferrara et al.
2007/0240252 A1 10/2007 Leonard et al.
2008/0028505 A1 2/2008 Penn
2008/0058239 A1 3/2008 Evers et al.
2008/0058240 A1 3/2008 Evers et al.
2008/0086801 A1 4/2008 Virica et al.
2008/0099041 A1 5/2008 Evers et al.
2008/0269097 A1 10/2008 Cheung et al.
2008/0272200 A1 11/2008 Ordiway et al.
2008/0290089 A1* 11/2008 Ciarrocchi, Jr. ..... B65D 25/20 220/23.4
2008/0303298 A1* 12/2008 Jones ..... A47J 45/078 294/31.2
2008/0313795 A1 12/2008 Lu
2009/0000016 A1 1/2009 Sawalski et al.
2009/0119825 A1 5/2009 Wilson et al.
2009/0249533 A1 10/2009 Sawalski et al.
2009/0260658 A1 10/2009 Miyagi et al.
2010/0071121 A1 3/2010 Kissner et al.
2010/0146687 A1 6/2010 King et al.
2010/0155426 A1 6/2010 Hsu
2010/0180365 A1 7/2010 Shasho
2010/0205727 A1 8/2010 Muehlhausen et al.
2010/0205728 A1 8/2010 Muehlhausen et al.
2010/0205730 A1 8/2010 Muehlhausen et al.
2010/0205731 A1 8/2010 Muehlhausen et al.
2010/0205732 A1 8/2010 Muehlhausen et al.
2010/0212074 A1 8/2010 Burt et al.
2010/0235976 A1 9/2010 Cooper et al.
2010/0299818 A1 12/2010 Lu
2011/0083257 A1 4/2011 Lampe
2012/0047640 A1 3/2012 Warkotsch et al.
2012/0110722 A1 5/2012 Abbondanzio et al.
2012/0153038 A1* 6/2012 Willert ..... A61L 9/12 239/34
2012/0174304 A1 7/2012 Abbondanzio et al.
2012/0266368 A1 10/2012 Butter-Jentsch et al.
2012/0266369 A1 10/2012 Butter-Jentsch et al.
2012/0266920 A1* 10/2012 Burt ..... E03D 9/005 134/24
2013/0019388 A1 1/2013 Bulala et al.
2013/0104304 A1 5/2013 Wilson et al.
2013/0239313 A1 9/2013 Schiedel et al.
2013/0294967 A1 11/2013 Blondeau et al.
2013/0298320 A1 11/2013 Duncan
2014/0068848 A1 3/2014 Neo
2014/0075663 A1 3/2014 Irwin et al.
2014/0076991 A1 3/2014 Irwin et al.
2015/0159358 A1 6/2015 Burt et al.
2015/0167282 A1 6/2015 Lehmann et al.
2016/0024773 A1 1/2016 Page et al.
2016/0032576 A1 2/2016 Leffler et al.
2016/0101205 A1 4/2016 Irwin et al.
2017/0247869 A1* 8/2017 Soller ..... E03D 9/032

* cited by examiner

TOILET BOWL TREATMENT APPARATUS AND METHOD OF MAKING SAME

BACKGROUND OF THE DISCLOSURE

The subject matter described herein relates generally to a toilet bowl treatment apparatus and, more particularly, to a toilet bowl deodorizing and/or cleaning apparatus and a method of making the same.

Many known toilet bowl treatment apparatuses include a hanger and a solid block of treatment material (e.g., deodorizing material and/or cleaning material) extruded onto the end of the hanger such that, when the hanger is coupled to the rim of a toilet bowl, the block of treatment material is suspended in the path of water entering the toilet bowl during a flushing event. In this manner, the water entering the toilet bowl gradually erodes the block of material over time, by washing particles of the material into the toilet bowl. When the block is substantially depleted, the entire apparatus (including the hanger) is discarded and replaced with a new apparatus. However, it can be costly to make a new hanger for each apparatus, and to extrude each block of treatment material onto its associated hanger. This typically results in the apparatus being more costly to the end-user, in that the end-user needs to purchase another whole apparatus (including a new hanger) once a used apparatus is in need of replacement.

It would be useful, therefore, to provide an apparatus having a treatment material that can be coupled to a hanger in a more cost-effective manner, such that the treatment material is refillable and the hanger is reusable, thereby reducing the cost of making the apparatus and thus rendering the apparatus more affordable for the end-user.

BRIEF DESCRIPTION OF THE DISCLOSURE

In one aspect, a toilet bowl treatment apparatus is provided. The apparatus includes a hanger having a detent, and a blister-type cartridge having a tray, a treatment material disposed in the tray, and a cover removably coupled to the tray over the treatment material. The cartridge also has a detent that releasably engages the detent of the hanger for detachably coupling the cartridge to the hanger.

In another aspect, a disposable cartridge for a toilet bowl treatment apparatus including a hanger having a detent is provided. The cartridge is a blister-type cartridge and includes a tray, a treatment material disposed in the tray, and a cover removably coupled to the tray over the treatment material. The cartridge further includes a detent that releasably engages the detent of the hanger for detachably coupling the cartridge to the hanger.

In another aspect, a method of making a disposable cartridge for a toilet bowl treatment apparatus including a hanger having a detent is provided. The method includes providing a tray having a detent that releasably engages the detent of the hanger for detachably coupling the cartridge to the hanger. The method also includes inserting a treatment material into the tray, and removably coupling a cover to the tray over the treatment material such that the cartridge is a blister-type cartridge.

DETAILED DESCRIPTION OF THE DISCLOSURE

The methods and systems described herein facilitate providing a toilet bowl treatment apparatus that is made in a more cost-effective manner, which in turn results in the apparatus being more affordable to the end-user. Particularly, because the methods and systems facilitate providing a toilet bowl treatment apparatus having a blister-type cartridge of treatment material that is easily assembled to a hanger, the cartridge and the hanger can be mass-produced in a more streamlined and cost-effective manner. Moreover, the methods and systems described herein further facilitate providing a toilet bowl treatment apparatus that is refillable, which again results in the apparatus being more affordable to the end-user. Specifically, the methods and systems facilitate providing a toilet bowl treatment apparatus having a hanger to which refill cartridges are selectively coupled, such that the hanger is reusable.

Figure 1:
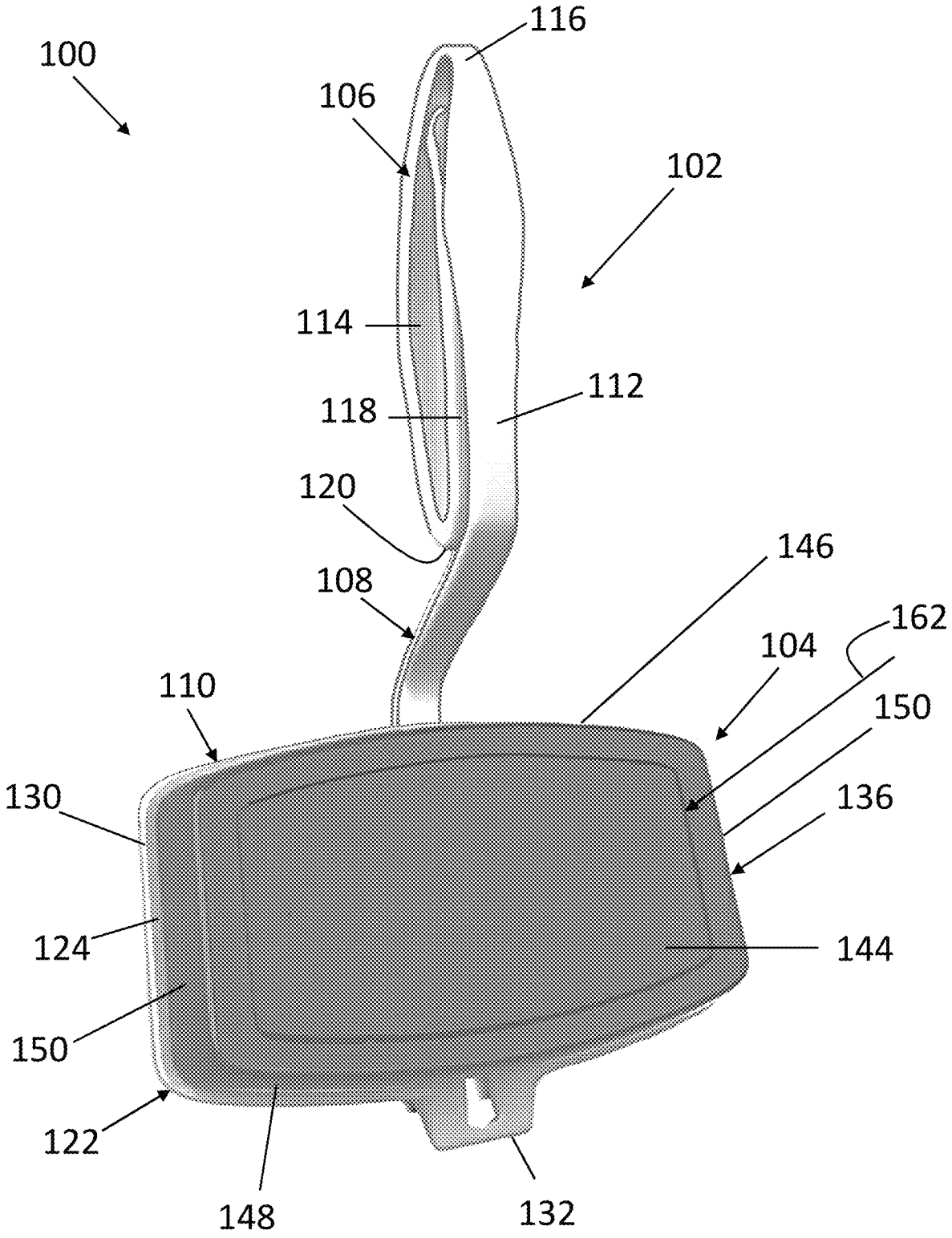
FIG. 1 is a back perspective view of an exemplary toilet bowl treatment apparatus.
Figure 2:
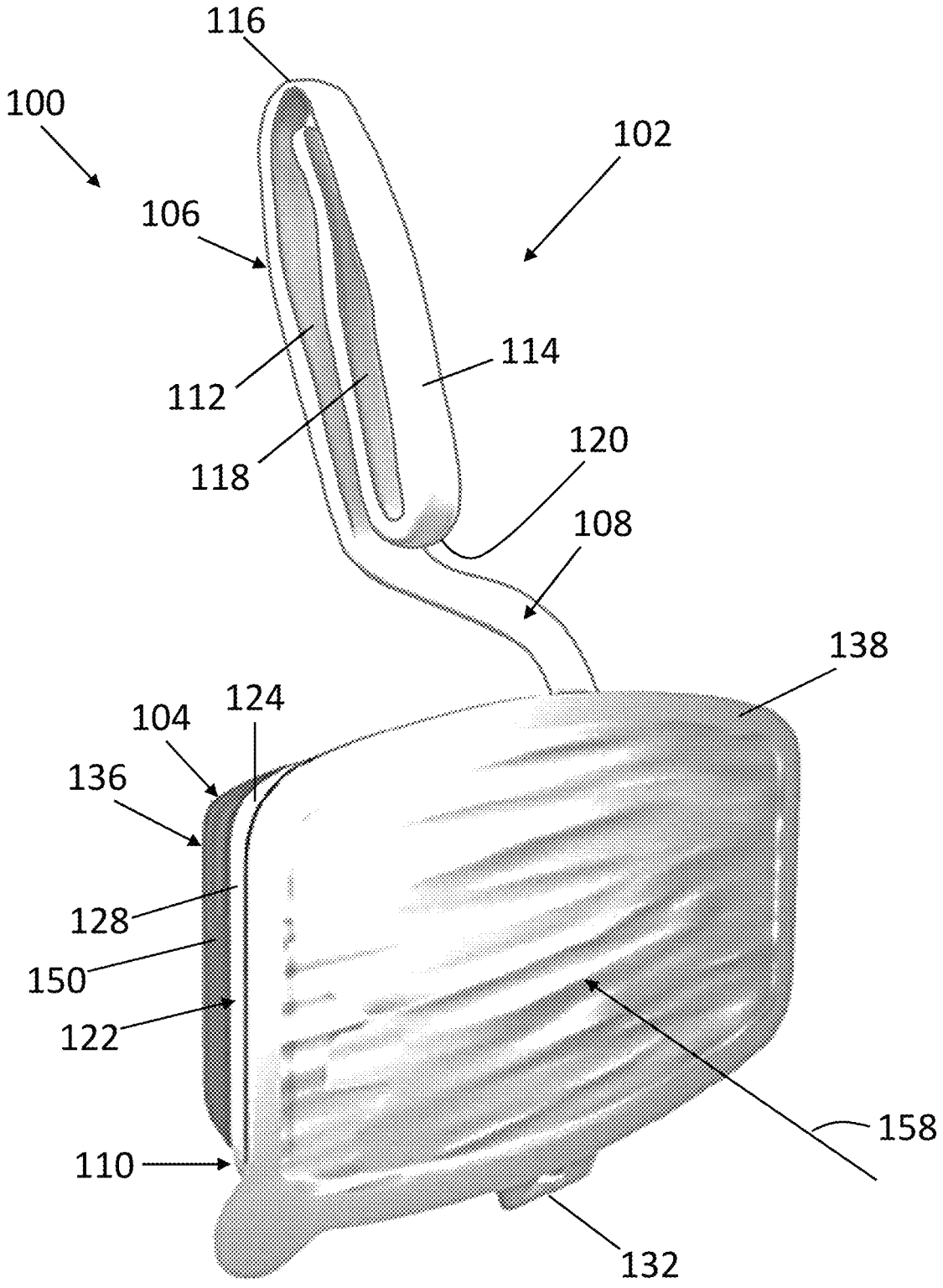
FIG. 2 is a front perspective view of the apparatus shown in FIG. 1.
Figure 3:
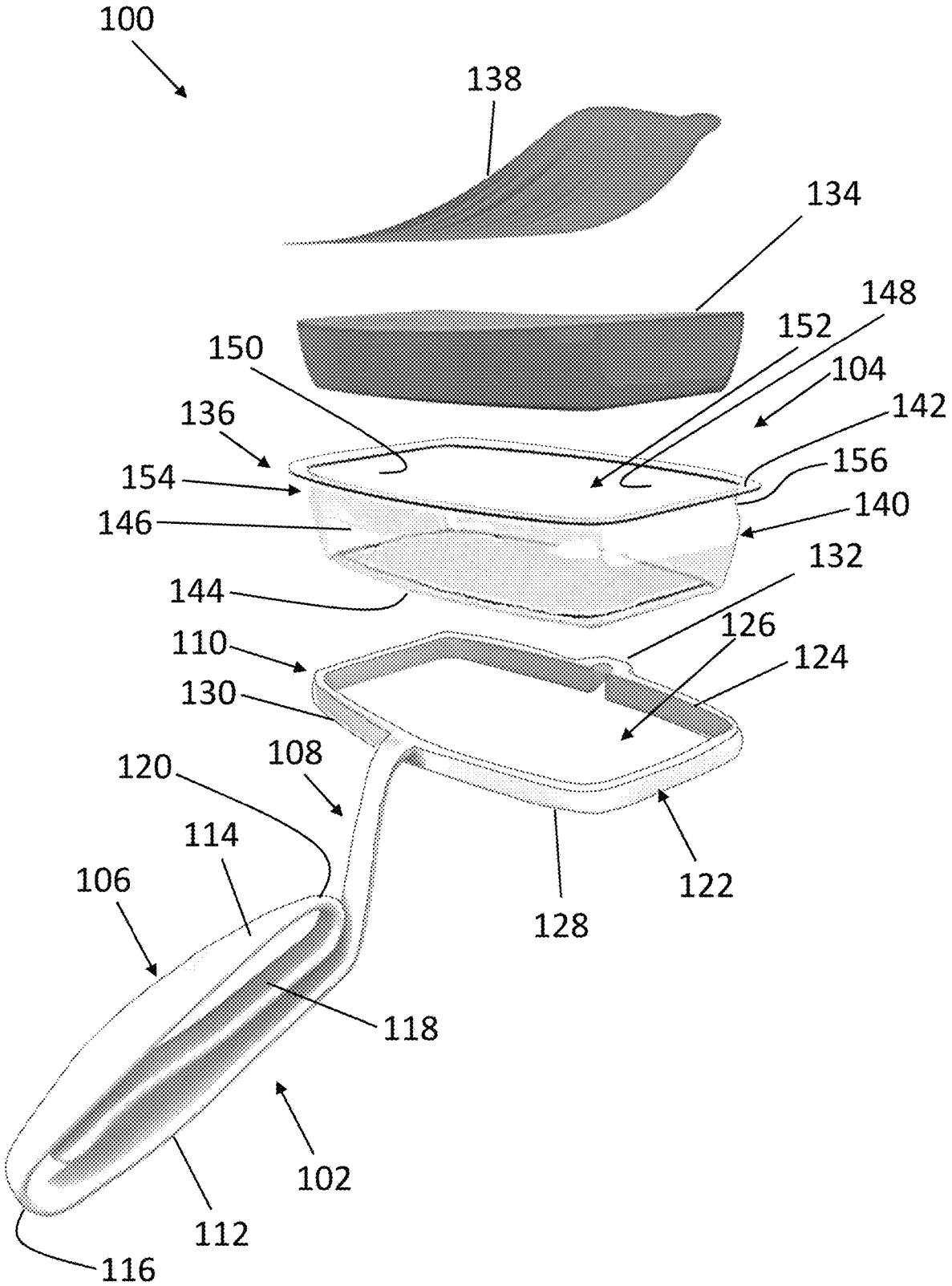
FIG. 3 is an exploded view of the apparatus shown in FIG. 1.

FIGS. 1-3 are various views of an exemplary toilet bowl treatment apparatus 100. Apparatus 100 includes a hanger 102 and a cartridge 104 detachably coupled to hanger 102. Although apparatus 100 has only one hanger and only one cartridge in the exemplary embodiment, apparatus 100 may have any suitable number of hangers and any suitable number of corresponding cartridges detachably coupled to the hangers in other embodiments. For example, in one embodiment, apparatus 100 may have one hanger and two cartridges detachably coupled to the hanger.

In the exemplary embodiment, hanger 102 includes a hook 106, an arm 108, and a holder 110 that are integrally formed together as a single-piece, unitary structure. Alternatively, hanger 102 may have any number of components that are formed separately from one another and coupled together in a suitable manner. For example, hook 106 and arm 108 (and/or arm 108 and holder 110) may be separate structures that are coupled together using at least one mechanical joint or are otherwise bonded together using a suitable bonding process such as, for example, ultrasonic welding. Although hanger 102 is made from a plastic material in the exemplary embodiment, hanger 102 may be made from any suitable material in other embodiments.

Figure 5:
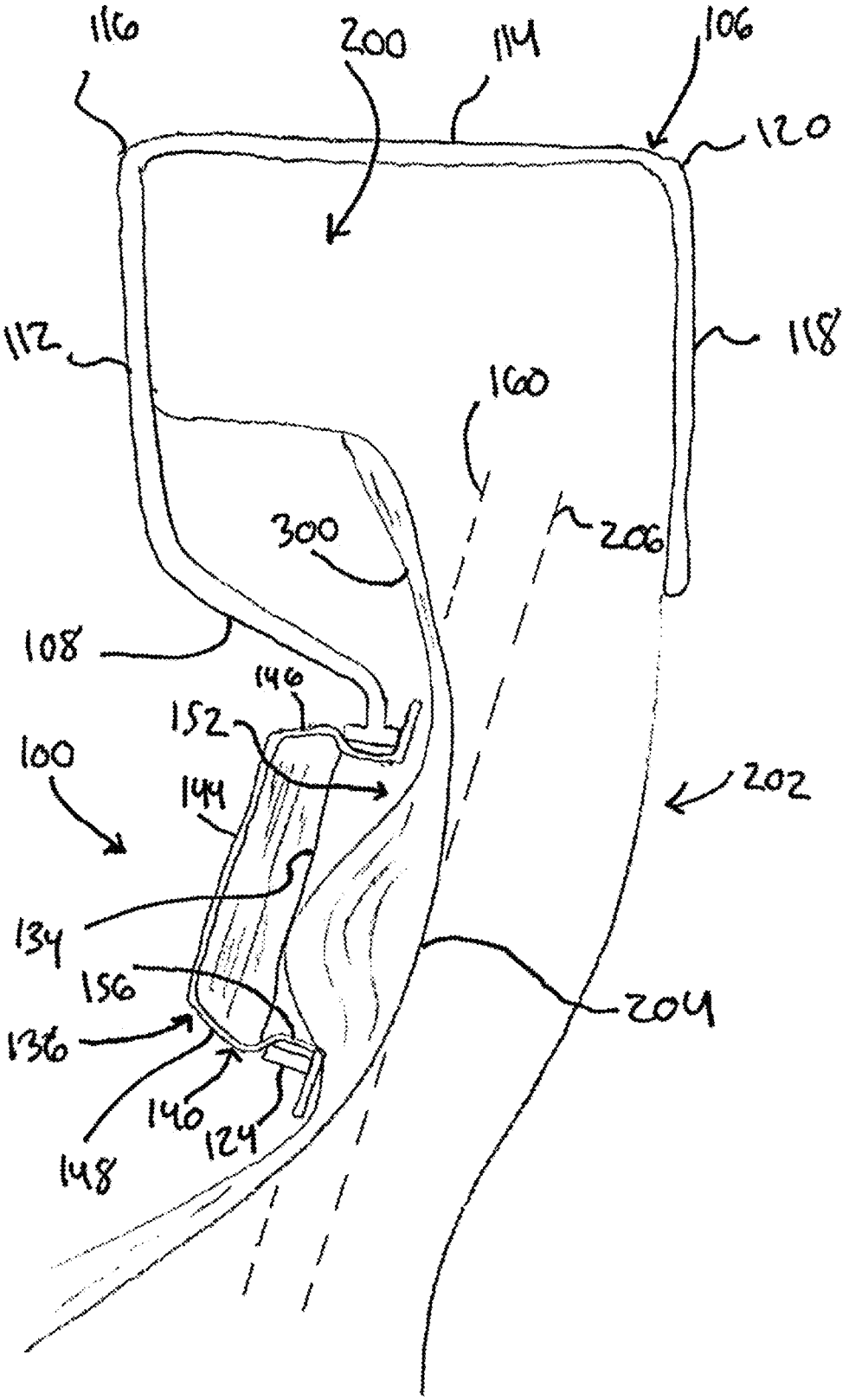
FIG. 5 is a schematic illustration of the prepared apparatus shown in FIG. 4 when deployed.

In the exemplary embodiment, hook 106 is a bent structure that is flexible at least in part, such that hook 106 has a collapsed state (which is shown in FIGS. 1-3) and is expandable from its collapsed state into an expanded state (which is shown in FIG. 5) when deployed. Hook 106 includes a first beam 112, a second beam 114 extending from first beam 112 at a first joint 116, and a third beam 118 extending from second beam 114 at a second joint 120. Beams 112, 114, 118 and joints 116, 120 are integrally formed together as single-piece, unitary structure. Beams 112, 114, 118 are straight and relatively inflexible (or rigid) as compared to joints 116, 120, and joints 116, 120 are curved and relatively flexible as compared to beams 112, 114, 118. Joints 116, 120 are formed (e.g., pre-stressed) so as to bias hook 106 into its collapsed state, in which beams 112, 114, 118 are substantially parallel to one another with third beam 118 being positioned between first beam 112 and second beam 114 as shown in FIGS. 1-3. However, joints 116, 120 are flexible enough to permit manually expanding hook 106 and orienting second beam 114 substantially perpendicular to first beam 112 and third beam 118, such that hook 106 has a substantially U-shaped profile for firmly gripping the rim of a toilet bowl (as shown in FIG. 5). Optionally, hook 106 may have any number of beams and joints arranged in any suitable manner in other embodiments (e.g., hook 106 may have only one beam that is bent and flexible for gripping the rim of a toilet bowl, such that hook 106 has no joints). Alternatively, hook 106 may not be a single-piece, unitary structure with beams and joints but, rather, may instead be an assemblage of separately-formed components that are each of any suitable shape/function and are mechanically coupled (or bonded) together so as to facilitate clamping onto the rim of a toilet bowl in any suitable manner.

Holder 110 includes a detent 122 for releasably engaging and retaining cartridge 104. In the exemplary embodiment, detent 122 includes a band 124 that circumscribes and defines an aperture 126 sized to receive cartridge 104. Band 124 is at least in part flexible, so as to be expandable for selectively increasing a crosswise dimension (e.g., a radius, a diameter, etc.) of aperture 126. More specifically, detent 122 includes a first band segment 128, a second band segment 130, and a flexible joint 132 between first band segment 128 and second band segment 130 such that first band segment 128, second band segment 130, and joint 132 collectively circumscribe aperture 126. Although aperture 126 is generally rectangular in the exemplary embodiment, aperture 126 may have any suitable shape in other embodiments. Additionally, although detent 122 includes band 124 that defines aperture 126 in the exemplary embodiment, detent 122 may include any suitable type of flexible clip that facilitates releasably engaging and retaining cartridge 104 in any suitable manner in other embodiments. Moreover, although detent 122 is at least in part flexible in the exemplary embodiment, detent 122 may not be flexible in some embodiments (e.g., detent 122 may be a rigid structure that releasably engages a flexible clip of cartridge 104 in some embodiments).

In the exemplary embodiment, cartridge 104 is a blister-type cartridge that includes a toilet bowl treatment material 134 enclosed within a tray 136 by a removable cover 138. Tray 136 is made of a plastic material such as, for example, a thermoformed plastic material. Tray 136 has a pocket 140 and a peripheral lip 142 that circumscribes pocket 140 such that pocket 140 and lip 142 are integrally formed together as a single-piece, unitary structure. Pocket 140 has a back wall 144, in addition to a top wall 146, a bottom wall 148, a pair of side walls 150 that collectively define a front opening 152 opposite back wall 144. Walls 146, 148, 150 are shaped and/or oriented in a converging manner so as to taper from front-to-back (i.e., from near front opening 152 toward back wall 144, such that front opening 152 is larger than back wall 144). Notably, treatment material 134 may have any suitable composition (or formulation) for use in deodorizing the ambient air around, and/or cleaning the inside of, a toilet bowl as set forth in more detail below. Moreover, in the exemplary embodiment, treatment material 134 is in the form of a gel (e.g., a colored gel such as a green gel or a blue gel) that occupies at least part of pocket 140. Alternatively, treatment material 134 may not be in the form of a gel (e.g., treatment material 134 may instead be in the form of a solid block or a plurality of bound-together particles (solid or gel) in some embodiments).

In the exemplary embodiment, cover 138 is gas impermeable and liquid impermeable (e.g., cover 138 is a foil), and cover 138 is sized to span the entire front opening 152 and thus enclose pocket 140 when cover 138 is coupled to lip 142 of tray 136, thereby sealing (e.g., hermetically sealing) treatment material 134 within pocket 140. In one embodiment, tray 136 (e.g., pocket 140) may be transparent or translucent such that treatment material 134 is visible from the exterior of tray 136 through walls 144, 146, 148, and/or 150 of pocket 140. In another embodiment, tray 136 may be opaque (i.e., not transparent or translucent) such that treatment material 134 is not visible from the exterior of tray 136 through wall(s) 144, 146, 148, 150 of pocket 140.

Cartridge 104 further includes a detent 154 for releasably engaging holder detent 122, to facilitate keeping cartridge 104 attached to holder 110 when apparatus 100 is deployed as set forth in more detail below. In the exemplary embodiment, cartridge detent 154 includes an indentation 156 (e.g., a groove that, for example, circumscribes pocket 140), and indentation 156 is defined by at least one wall 146, 148, 150 at the interface of lip 142 and wall(s) 146, 148, 150. Notably, indentation 156 is contoured to receive holder detent 122 so as to inhibit (but not prevent) detent 122 against dislodging from (e.g., sliding out of) indentation 156. More specifically, indentation 156 is contoured such that, when detent 122 is seated therein, detent 122 can dislodge from indentation 156 only when a predetermined detachment force is applied to cartridge 104, as set forth in more detail below. Although pocket 140 has a substantially rectangular cross-sectional external profile that nearly matches the substantially rectangular shape of aperture 126 in the exemplary embodiment, pocket 140 may have any suitable non-rectangular (e.g., substantially elliptic) cross-sectional external profile in other embodiments (if, for example, aperture 126 has a non-rectangular shape, such as a substantially elliptic shape). Additionally, although cartridge detent 154 includes indentation 156 in the exemplary embodiment, detent 154 may include any suitable feature that facilitates releasably engaging holder 110 in any suitable manner in other embodiments. Moreover, although cartridge detent 154 is not flexible in the exemplary embodiment, detent 154 may be flexible in some embodiments (e.g., detent 154 may include a flexible clip that engages a rigid detent of holder 110 in some embodiments).

Figure 4:
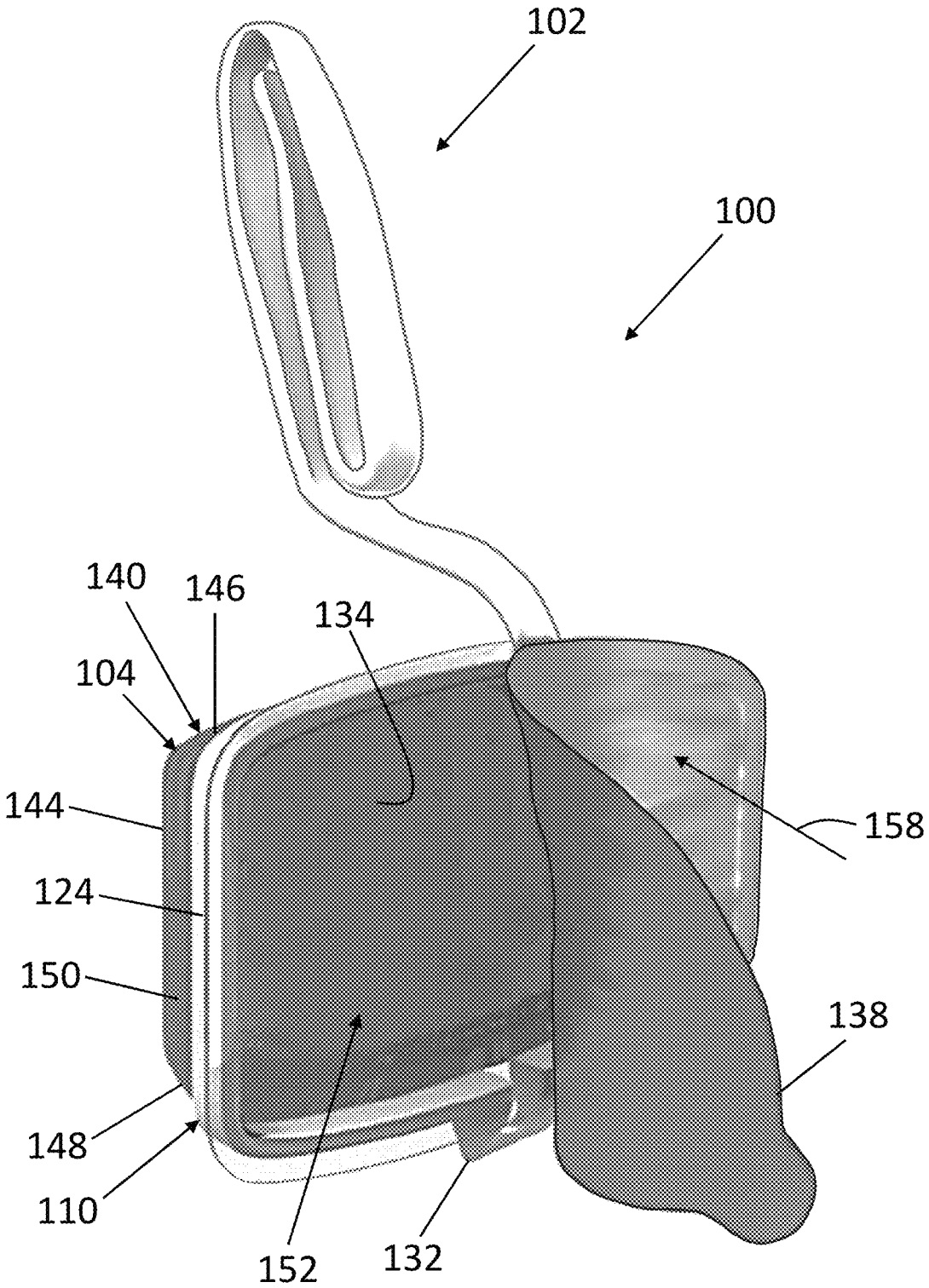
FIG. 4 is a front perspective view of the apparatus shown in FIG. 1 when being prepared for deployment.

FIG. 4 is a front perspective view of apparatus 100 when being prepared for deployment. Constructed in the manner set forth above, cartridge 104 is coupled to hanger 102 (as shown in FIGS. 1 and 2) by inserting cartridge 104 into aperture 126 (shown in FIG. 3) of holder 110 back-wall-first in an attachment direction 158. Notably, in an unexpanded state of band 124, aperture 126 is smaller than the largest cross-sectional external profile of pocket 140 between back wall 144 and indentation 156 (shown in FIG. 3) such that, when cartridge 104 is inserted into aperture 126, at least one wall 146, 148, 150 functions as a wedge-like cam to expand band 124 (and thus widen aperture 126) by flexing joint 132 until band 124 is large enough to snap into indentation 156. After snapping in place, band 124 wraps around the top, bottom, and sides of cartridge 104, but not around the front or back of cartridge 104. Apparatus 100 can then be prepared for deployment by removing cover 138 from front opening 152, thereby exposing treatment material 134 to the ambient. Notably, holder 110 does not completely envelop the entire cartridge 104 in the exemplary embodiment (i.e., holder 110 is not a cage-like structure that surrounds the entire cartridge 104). Rather, in the exemplary embodiment, when cartridge 104 is coupled to holder 110, all of cartridge 104 (except indentation 156) is unconfined and fully exposed to the ambient. Alternatively, in other embodiments, holder 110 may be a cage-like structure that surrounds the entire cartridge 104 (i.e., holder 110 may completely envelop the entire cartridge 104 in other embodiments).

FIG. 5 is a schematic illustration of the prepared apparatus 100 shown in FIG. 4 when deployed. To deploy apparatus 100, hook 106 can be manually expanded into its U-shaped profile and seated on the rim 200 of a toilet bowl 202 such that, when hook 106 is released, hook 106 firmly grips rim 200. In this manner, arm 108 extends from hook 106 into toilet bowl 202 and positions tray 136 adjacent an inner surface 204 of toilet bowl 202, such that a plane 160 that extends across front opening 152 is oriented substantially parallel with a plane 206 that is tangent to inner surface 204 of toilet bowl 202, with the planes 160, 206 being spaced apart from one another to permit a flow of water 300 therebetween.

During a toilet flushing event, water 300 flows down inner surface 204 and into front opening 152 of pocket 140, such that water 300 contacts treatment material 134, thereby removing part of treatment material 134 to deodorize and/or clean toilet bowl 202. Hook 106 can thus be uncoupled from rim 200 to replace cartridge 104 as desired (e.g., when substantially all of treatment material 134 has been eroded from pocket 140 a result of repeated flushing events). Conveniently, the state of treatment material 134 is apparent from a visible inspection of treatment material 134 through walls 144, 146, 148, and/or 150 of pocket 140 when apparatus 100 is attached to rim 200. After unseating hook 106 from rim 200, the used cartridge 104 can be manually pushed out of aperture 126 by imparting the predetermined detachment force to back wall 144 of pocket 140 in a detachment direction 162 (shown in FIG. 1) that is opposite attachment direction 158 (shown in FIGS. 2 and 4), thereby dislodging band 124 from indentation 156. A new cartridge 104 can then be inserted into aperture 126 after removing its cover 138 from its tray 136, and hook 106 can then be reseated on rim 200 with the new cartridge 104 likewise positioned in the path of water 300 for continued deodorizing and/or cleaning of toilet bowl 202. The used cartridge 104 can then be disposed of in an appropriate manner.

The methods and systems described herein facilitate providing a toilet bowl treatment apparatus that is made in a more cost-effective manner, which in turn results in the apparatus being more affordable to the end-user. Particularly, because the methods and systems facilitate providing a toilet bowl treatment apparatus having a blister-type cartridge of treatment material that is easily assembled to a hanger, the cartridge and the hanger can be mass-produced in a more streamlined and cost-effective manner. Moreover, the methods and systems described herein further facilitate providing a toilet bowl treatment apparatus that is refillable, which again results in the apparatus being more affordable to the end-user. Specifically, the methods and systems facilitate providing a toilet bowl treatment apparatus having a hanger to which refill cartridges are selectively coupled, such that the hanger is reusable.

Exemplary embodiments of an apparatus are described above in detail. The apparatus described herein is not limited to the specific embodiments described herein, but rather, components of the apparatus may be utilized independently and separately from one another. For example, the apparatus described herein may have other applications not limited to deodorizing or cleaning a toilet bowl, as described herein. Rather, the apparatus described herein can be implemented and utilized in connection with various other industries.

This written description uses example embodiments, while disclosing the best mode and enabling any person skilled in the art to practice the example embodiments, including making and using any devices or systems and performing any incorporated methods. The patentable scope of this disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A toilet bowl treatment apparatus comprising:

a hanger comprising:

a hook configured to engage a surface of a toilet bowl;

an arm extending from said hook to a distal end of said arm; and a flexible band comprising a first band segment and a second band segment each extending from said distal end of said arm, said flexible band forming an integrally closed path that defines an aperture, said flexible band comprising a joint integral with and between said first band segment and said second band segment at a position of said flexible band opposite said distal end of said arm, said joint being flexible to facilitate expanding said flexible band to selectively increase a crosswise dimension of the aperture; and a blister-type cartridge comprising:

a tray comprising a back wall and at least one side wall extending obliquely from said back wall and defining a wedge shape that engages said flexible band during insertion of said cartridge into the aperture to increase the crosswise dimension of the aperture;

a treatment material disposed in said tray;

a cover removably coupled to said tray over said treatment material; and a cartridge detent that releasably engages said flexible band of said hanger for detachably coupling said cartridge to said hanger such that said cover is accessible for removal from said tray when said cartridge is coupled to said hanger, wherein said closed path flexible band circumscribes said tray when said cartridge is coupled to said hanger.

2. A toilet bowl treatment apparatus in accordance with claim 1, wherein said tray is a thermoformed tray.

3. A toilet bowl treatment apparatus in accordance with claim 1, wherein said tray comprises a pocket in which said treatment material is disposed.

4. A toilet bowl treatment apparatus in accordance with claim 1, wherein said cartridge detent of said cartridge comprises an indentation sized to receive said flexible band.

5. A toilet bowl treatment apparatus in accordance with claim 1, wherein said treatment material is a gel.

6. A toilet bowl treatment apparatus in accordance with claim 1, wherein said tray is one of transparent and translucent.

7. A toilet bowl treatment apparatus in accordance with claim 1, wherein said at least one side wall comprises a plurality of side walls collectively defining a substantially rectangular cross-sectional external profile of said tray.

8. A toilet bowl treatment apparatus in accordance with claim 7, wherein the aperture is rectangular.

9. A toilet bowl treatment apparatus in accordance with claim 7, wherein said plurality of side walls comprises a first long wall, a second long wall, a first short wall, and a second short wall, said first short wall and said second short wall each extending between said first long wall and said second long wall.

10. A toilet bowl treatment apparatus in accordance with claim 9, wherein said distal end of said arm is positioned adjacent a midpoint of said first long wall approximately equidistant from said first short wall and said second short wall when said cartridge is coupled to said hanger.

11. A toilet bowl treatment apparatus in accordance with claim 10, wherein said joint is positioned adjacent a midpoint of said second long wall approximately equidistant from said first short wall and said second short wall when said cartridge is coupled to said hanger.

12. A method of making a toilet bowl treatment apparatus, said method comprising:

providing a hanger including a hook configured to engage a surface of a toilet bowl and an arm extending from the hook to a distal end of the arm, the hanger further including a flexible band including a first band segment and a second band segment each extending from the distal end of the arm, the flexible band forming an integrally closed path that defines an aperture, the flexible band including a joint integral with and between the first band segment and the second band segment at a position of the flexible band opposite the distal end of the arm, the joint being flexible to facilitate expanding the flexible band to selectively increase a crosswise dimension of the aperture;

providing a cartridge including a tray, the tray including a back wall and at least one side wall extending obliquely from the back wall and defining a wedge shape, the tray further including a cartridge detent that releasably engages the flexible band of the hanger for detachably coupling the cartridge to the hanger;

inserting the cartridge into the aperture to cause the at least one side wall to engage the flexible band and increase the crosswise dimension of the aperture;

inserting a treatment material into the tray; and removably coupling a cover to the tray over the treatment material such that the cartridge is a blister-type cartridge, and such that the cover is accessible for removal from the tray when the cartridge is coupled to the hanger.

13. A method in accordance with claim 12, wherein providing the tray comprises thermoforming the tray.

14. A method in accordance with claim 12, wherein inserting the treatment material into the tray comprises inserting the treatment material into a pocket of the tray.

15. A method in accordance with claim 14, wherein providing the tray comprises providing the tray with the cartridge detent including an indentation that receives the flexible band of the hanger.

16. A method in accordance with claim 15, wherein providing the tray comprises providing the tray with the indentation being a groove that circumscribes the pocket.

17. A method in accordance with claim 12, wherein inserting the treatment material into the tray comprises inserting the treatment material into the tray such that the treatment material forms a gel in the tray.

* * * * *